United States Patent [19]

McHeffey

[11] 4,074,462

[45] Feb. 21, 1978

[54] MULTI-POSITION WINDOW

[75] Inventor: Murray Parker McHeffey, Little Silver, N.J.

[73] Assignee: Extrudart Metal Products, Inc., Clifton, N.J.

[21] Appl. No.: 747,491

[22] Filed: Dec. 6, 1976

[51] Int. Cl.[2] ..... E06B 11/00

[52] U.S. Cl. ..... 49/192; 49/394

[58] Field of Search ..... 49/192, 394

[56] References Cited

U.S. PATENT DOCUMENTS 3,538,641 11/1970 Miller et al. ..... 49/192

3,855,824 12/1974 Falk ..... 70/389 X 3,911,621 10/1975 McHeffey ..... 49/192

*Primary Examiner*—Philip C. Kannan

*Attorney, Agent, or Firm*—Peter L. Berger

[57] ABSTRACT

A foolproof mechanism for operating a multi-positioned window is disclosed for general use, but is particularly suitable to institutional, commercial, industrial and other buildings with unrestricted ingress, and the window has a handle capable of allowing it to be in a tilt, swing, or closed position. Means are provided to lock the handle in each of the positions, when the window assumes the desired open position.

7 Claims, 5 Drawing Figures

FIG. 2
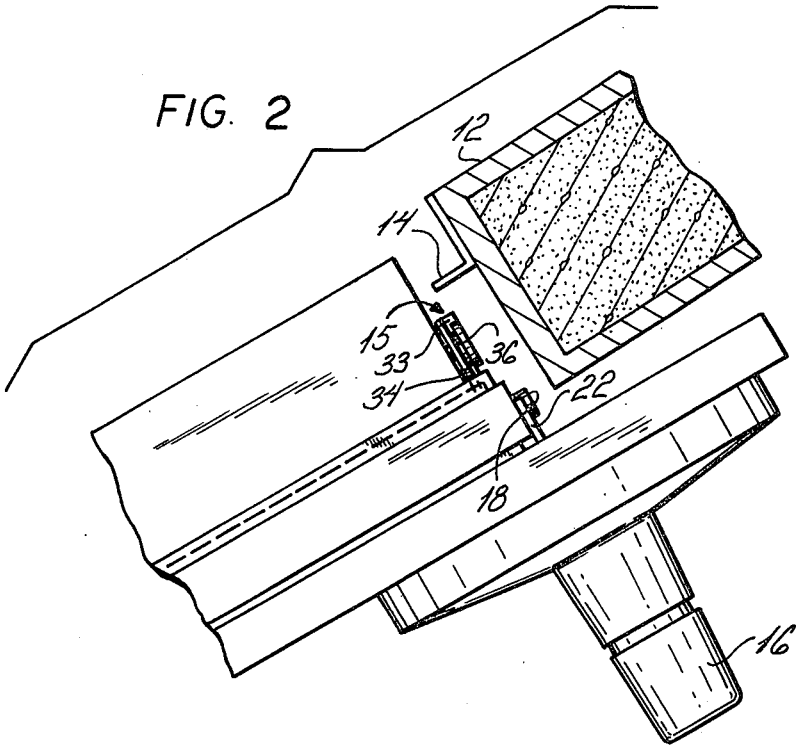
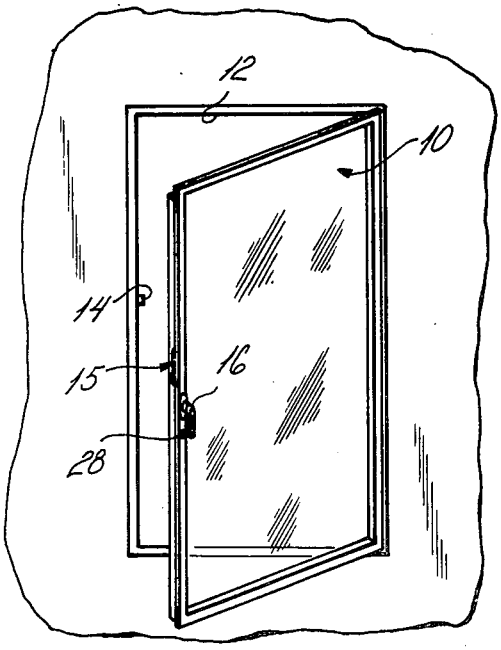
FIG. 1

MULTI-POSITION WINDOW

RELATED APPLICATIONS

U.S. Pat. No. 3,911,621 entitled "MULTI-PURPOSE WINDOW", issued on Oct. 4, 1975 to Murray P. McHeffey.

BACKGROUND OF THE INVENTION

This invention relates to a foolproof mechanism used with a multi-purpose window, and more particularly, for a window as disclosed in my prior patent, U.S. Pat. No. 3,911,621, issued on Oct. 14, 1975 entitled "MULTI-PURPOSE WINDOW".

Provision is made for any person to move the windows to a tilt position, that is, where the window top is opened, while the bottom remains closed in order to permit ventilation. For purposes of cleaning, an authorized user is able to swing the window open, that is by pivoting it on its vertical edge axis along the side of the window. The window is also capable of being in a closed position.

It has been found that when the handle is operated to open the window to the tilt position, the handle is sometimes moved from that position to a different position. This causes a drive train controlled by the handle described in my prior patent, to be moved accordingly, which results in an incorrect placement of the various elements controlled by the drive train when the window is to be closed. Consequently, in some cases, the various elements controlled by the handle may be damaged when the window is closed with the handle in the incorrect position.

At other times, the person authorized to clean the window, or some other user is capable of operating the window to its swing position, as described in my prior patent. When the handle is moved to the requisite position, the window is swung open, and the authorized person is capable of cleaning the window. In some cases, such authorized person incorrectly moves the handle to a different position when the window is swung open, thus causing the drive train to be moved to a position which does not correspond to the swung-open position. Consequently, when the window is closed, if the handle is in the incorrect position, jamming or damage to the drive train and its associated elements may take place.

As a third area of importance, it has been found that some of the personnel who control the window to its swing open position sometimes leave the lock which is associated with the window in an enabling position. Consequently, one of the disadvantages is that when the authorized user leaves after completing his cleaning functions, anyone is capable of moving the window to its swung-open position because the lock had not been reset to its locked position.

An object of this invention is to provide a foolproof multi-purpose institutional-type window.

Another object of this invention is to provide such a window which is easy to be used, but significantly removes the possibility of human error in its operation.

Still another object of this invention is to provide such an improved foolproof system, which is easily capable of being added as a replacement window.

Yet another object of this invention is to provide such an improved multi-purpose window which is easy to use, yet durable.

And another object is to provide a means of fresh air ventilation in case of failure of the air conditioning or forced ventillation.

Other objects, advantages and features of this invention will become more apparent from the following description.

BRIEF DESCRIPTION OF THE INVENTION

In accordance with this invention, the above objects are accomplished by providing a window operating mechanism which locks the handle controlling the window position in its respective handle position. For instance, when the handle is moved upwardly to allow for a window tilt position, the drive train moved by the handle is locked when the window is tilted open, and the handle is prevented from movement from this position, unless the window is closed. Similarly, when the handle is moved down allowing for a swing open position, the drive train moved by the handle is locked when the window is swung open so that the handle cannot be moved from that position while the window is in the open position.

In accordance with the principles of this invention, the mechanism associated for maintaining the drive train in a locked position, when the handle is moved to respective positions is simple and is arranged to be attached to the window, with a strike being located in the frame of the window. The strike operates with a detent mechanism of this invention. A hook end is provided for the detent, controlled by a spring action, which will lock into respective notches in the train, as the drive train is at respective positions as the window is opened.

As a further feature of this invention, the key utilized with a conventional tumbler is the type which will be removed only when the lock is moved to its locking position. Thus, the key cannot be removed unless the window is locked in its closed position by an authorized person.

BRIEF DESCRIPTION OF THE DRAWINGS

FIG. 1 is a perspective view of the mechanism associated with the window described in more detail in my prior patent U.S. Pat. No. 3,911,621.

FIG. 2 is a sectional view of the window frame and window showing the novel cooperating members of my invention.

DETAILED DESCRIPTION

In accordance with this invention, there is provided a window 10, closeable into a frame 12, the frame being mounted in the conventional fashion. As shown in FIG. 1, the handle is approximately located in the middle of one side edge of the window, and a drive train is moved thereby, in accordance with the teachings of my prior patent, U.S. Pat. No. 3,911,621. In my prior patent, the mechanism for operating the drive train and handle was set forth, so that when the handle is in an up position, the window is capable of being moved to a tilt position, while when the handle is down, the window is capable of being moved to a swung open position. As illustrated in FIGS. 1 and 2, there is shown a strike 14 in the frame of the window which is capable of cooperating with the latching or detent mechanism 15 of this invention, so that the foolproof safety features of this invention are actuated.

Figure 3:
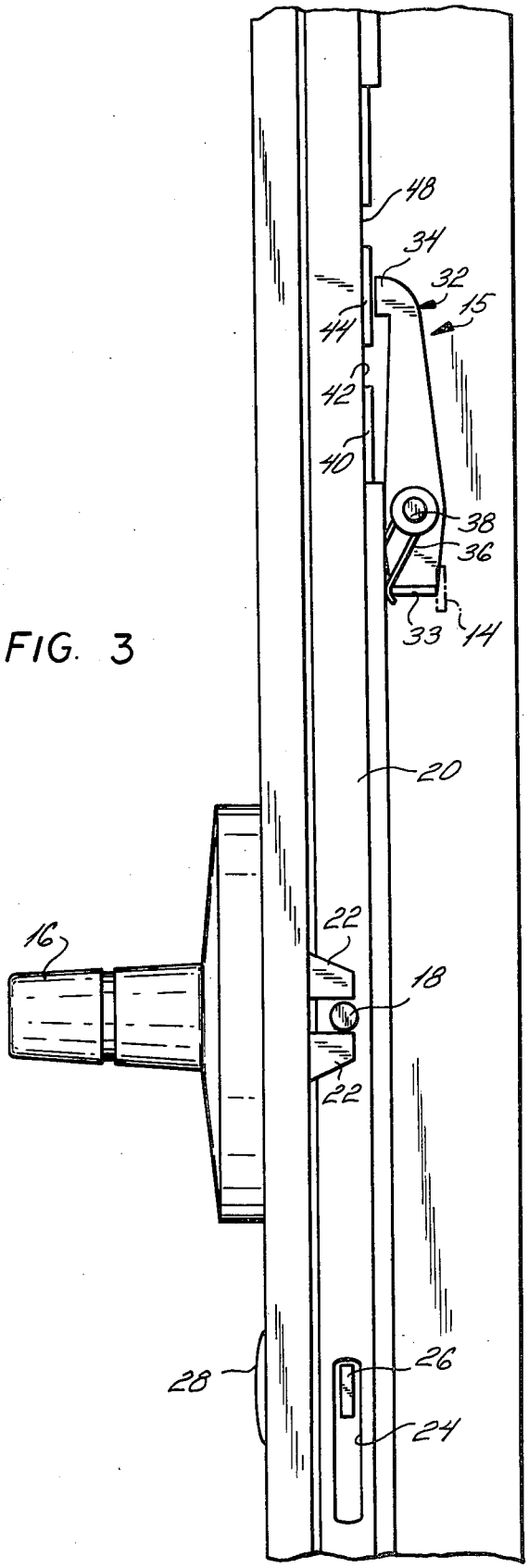
FIG. 3 is a sectional view illustrating the handle in the horizontal position with the window closed.
Figure 4:
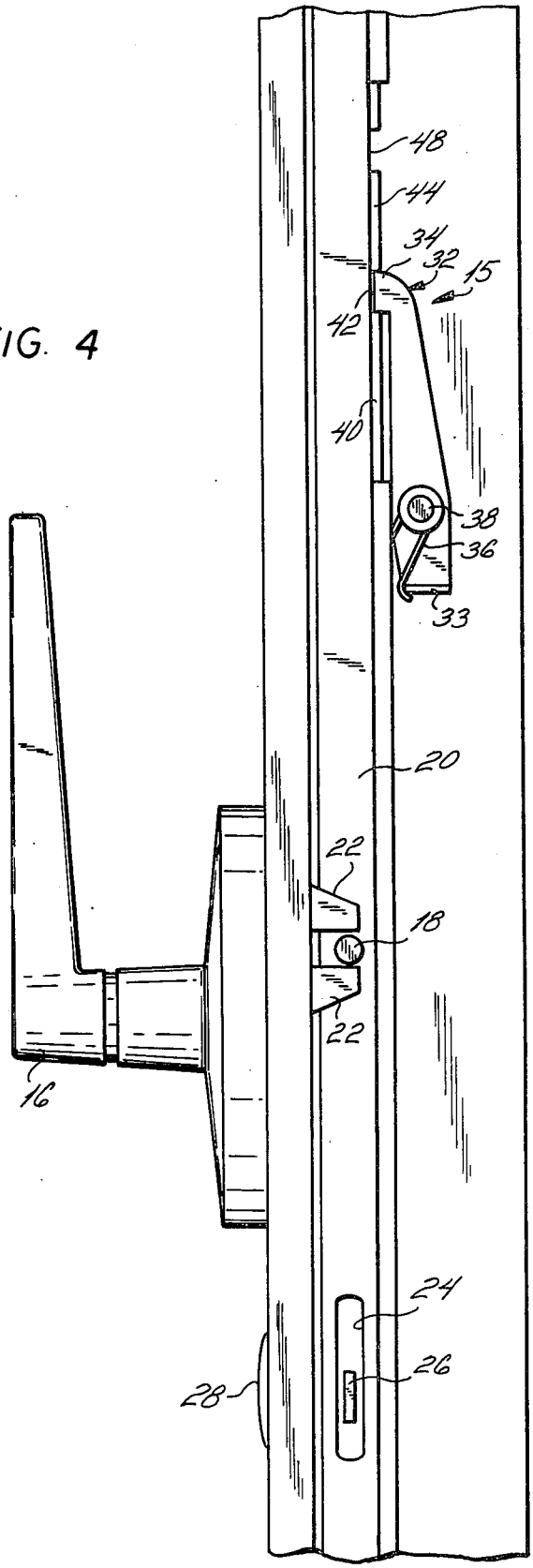
FIG. 4 is another sectional view similar to FIG. 3 illustrating the handle in the upward position allowing for a tilt movement of the window.

Referring now to FIG. 3, there is shown the handle 16 in a horizontal position with the associated pin 18 on the drive train 20 moveable around the window by controlling teeth 22 of the handle as illustrated. The drive train is also provided with a slot 24 in which is located a latch 26 of a key operated lock 28. As illustrated in this invention, there is provided a safety detent generally illustrated as 15, comprising a spring biased catch or latching member 32 having a hook end 34, with a spring 36 pivotal about point 38, urging the hook end 34 leftwardly, against a ridge 40 in the drive train 20. When the window is closed, as illustrated in FIG. 3, the drive train can move upwardly without any interference, by merely moving the handle to the up position, as illustrated in FIG. 4. However, the drive train cannot be moved downwardly because the latch 26 prevents such movement.

In FIG. 4, the handle is shown in the up position which allows for the window to assume a tilt position, as more fully described in my prior patent U.S. Pat. No. 3,911,621. The latch 26 does not interfere with the movement of the drive train 20, and freely moves within the slot 24 provided for the purpose. As can be seen in FIG. 4, the window has assumed its tilt position, and the strike 14 in the frame is no longer bearing against projecting end 33, so that the spring 36 operating projecting end 33 urges the hook end 34 into a land 42 associated between two ridges 44 and 40, respectively. As illustrated in FIG. 4, the hook 34 engages the land 42 so that the drive train 20 is blocked from movement. In order to free the drive train for further movement, it is necessary to close the window to allow the strike 14 to engage projection 33 causing hook end 34 to move out of blocking engagement with land 42. As can be understood, this can only be done when the window is closed, and in this fashion, it is impossible to move the handle from the tilt position when the window has been opened to the tilt position. In this manner, the drive train is locked in position until the window is closed from its tilt position.

Figure 5:
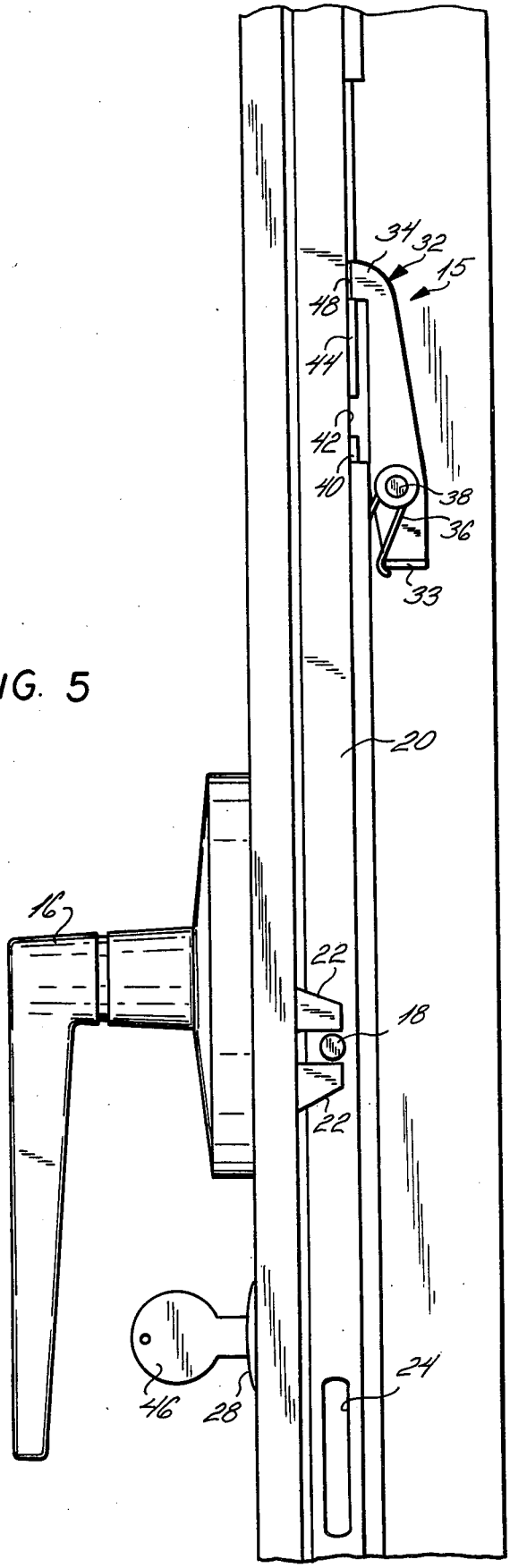
FIG. 5 is a sectional view similar to view 3 and 4 illustrating the handle in the down position allowing the window to be swung open.

Referring to FIG. 5, the handle is illustrated in the down position, which, as described in my prior patent, allows for the window to be swung open on its vertical side edge. The drive train 20 moves downwardly when the handle moves downwardly. Prior to the handle being able to move downwardly, it is necessary that the latch 26 controlled by lock 28 be moved out of its blocking position, and this is accomplished by means of the key 46. When latch 26 is so removed the drive train is capable of being moved downwardly while the window is closed as illustrated in FIG. 3. In this position, the hook end 34 of detent 32 will lock in land 48 located at the end of ridge 44 to prevent the drive train from being moved from this position, when the window is opened. It can thus be understood, that the window must first be closed, freeing the hook end 34 from land 48 by means of strike 14 in the window frame bearing against projection end 33 before the handle can be moved from its downward position.

As a further provision for foolproof operation, key 46 is associated with a lock 28 which is the type that will not permit the key to be removed unless it is moved to its locked position. Thus, the operator seeking to clean the window will not be able to take his key with him unless his window is closed and locked to prevent unauthorized downward movement of the handle.

It will thus be seen that the objects set forth above, among those made apparent from the preceding description, are efficiently attained and, since certain changes may be made in the above apparatus without departing from the scope of the invention, it is intended that all matter contained in the above description and shown in the accompanying drawings shall be interpreted as illustrative and not in a limiting sense.

What is claimed is:

1. In a multi-position window having a drive train coupled to a window handle, said drive train movable around the edge of the window cooperating with respective elements in the frame of the window to permit the window to be closed, tilted open, or swung open by movement of the handle and associated drive train to respective positions, an improvement comprising safety detent means connected to said window and actuated when said window is opened to either a tilt or swung open position to block said drive train against movement from the position corresponding to said respective open position of said window, said handle locked in the respective position enabling said window to assume said tilt or swung open positions, said safety detent means comprising a catch member spring biased to block movement of said train, a projecting end of said catch member and a strike attached to said frame bearing against said projecting end to move said catch member from said blocking position when the window is closed, further comprising a key operated latch, said train comprising a slot, said slot of said train and said latch cooperating to block movement of said handle to said swing open position and to permit movement of said handle for said window to assume said tilt position.

2. The improvement of claim 1, comprising a lock operated by said key, said lock preventing said key from being removed unless said key is in the locked position.

3. The improvement of claim 1, wherein said drive train is provided with a pair of ridges spaced apart by a land, said catch member engaging said land to block said train against movement when said land is moved by said handle to said tilt position and said window is tilted open.

4. The improvement of claim 3, wherein said catch member comprises a hook end engageable in said land.

5. The improvement of claim 3, wherein said catch member comprises a hook end engageable at one end of one of said ridges when said ridges are correspondingly moved by said handle and drive train and said window is swung open.

6. In a multi-position window having a drive train coupled to a window handle, said drive train movable around the edge of the window cooperating with respective elements in the frame of the window to permit the window to be closed, tilted open, or swung open by movement of the handle and associated drive train to respective positions, an improvement comprising safety detent means connected to said window and actuated when said window is opened to either a tilt or swung open position to block said drive train against movement from the position corresponding to said respective open position of said window, said handle locked in the respective position enabling said window to assume said tilt or swung open position, said safety detent means comprising a catch member spring biased to block movement of said train, a projecting end of said catch member and a strike attached to said frame bearing against said projecting end to move said catch member from said blocking position when the window is closed, said drive train being provided with a pair of ridges spaced apart by a land, said catch member comprising a hook and engaging said land to block said train against movement when said land is moved by said handle to said tilt position and said window is tilted open, and said hook end being engageable at one end of said ridges when said ridges are correspondingly moved by said handle and drive train and said window is swung open.

7. The improvement of claim 6, comprising a key operated latch and a slot in said train, said slot and latch cooperating to permit movement of said handle to permit said window to assume said tilt position.

* * * * *